US012234651B2

(12) United States Patent
Faraone

(10) Patent No.: US 12,234,651 B2
(45) Date of Patent: Feb. 25, 2025

(54) FIXING SYSTEM FOR A PANEL COMPRISING MEANS FOR ADJUSTING THE INCLINATION AND RELATIVE PROCEDURE FOR ADJUSTMENT

(71) Applicant: FARAONE S.R.L., Tortoreto (IT)

(72) Inventor: Flavio Faraone, Tortoreto (IT)

( * ) Notice: Subject to any disclaimer, the term of this patent is extended or adjusted under 35 U.S.C. 154(b) by 175 days.

(21) Appl. No.: 18/042,757

(22) PCT Filed: Aug. 30, 2021

(86) PCT No.: PCT/IB2021/057899
§ 371 (c)(1),
(2) Date: Feb. 23, 2023

(87) PCT Pub. No.: WO2022/049471
PCT Pub. Date: Mar. 10, 2022

(65) Prior Publication Data

US 2023/0323673 A1 Oct. 12, 2023

(30) Foreign Application Priority Data

Sep. 7, 2020 (IT) ..... 102020000021124

(51) Int. Cl.
*E04F 11/18* (2006.01)
*E04B 2/74* (2006.01)

(52) U.S. Cl.
CPC ..... *E04F 11/1812* (2013.01); *E04B 2/7405* (2013.01); *E04F 11/1851* (2013.01); *E04F 2011/1872* (2013.01)

(58) Field of Classification Search
CPC ..... E04F 11/1812; E04F 11/1851; E04F 11/1817; E04F 11/1834; E04F 2011/1872; E04F 2011/1823; E04B 2/7405
See application file for complete search history.

(56) References Cited

U.S. PATENT DOCUMENTS

2020/0087919 A1 3/2020 Ravan et al.
2022/0307268 A1* 9/2022 Pescini ..... E04F 11/1834

FOREIGN PATENT DOCUMENTS

EP 2905395 A1 8/2015
EP 3009580 A1 4/2016
(Continued)

OTHER PUBLICATIONS

International Search Report for corresponding PCT/IB2021/057899 dated Nov. 19, 2021.
(Continued)

*Primary Examiner* — Mark R Wendell
(74) *Attorney, Agent, or Firm* — Egbert, McDaniel & Swartz, PLLC

(57) ABSTRACT

Disclosed is an apparatus for the connection of one or more panels to a building element, the apparatus including: a support profile, provided with an anchor base fixed to an installation surface of the building element, a first and a second wing and a cavity, which acts as a seat for at least a portion or edge of the panel; a system designed to adjust the laying set-up of the panel with respect to the support profile, so as to adjust the inclination of the panel with respect to the building element or to panels adjacent thereto. The laying set-up adjustment system of the panel provides an adjustment assembly, capable of providing the edge of the panel with a controllable rotation around a fulcrum and of adjusting the inclination of said panel.

20 Claims, 9 Drawing Sheets

(56) References Cited

FOREIGN PATENT DOCUMENTS

| | | | |
|---|---|---|---|
| EP | 3892791 | B1 | 7/2023 |
| WO | 2015047109 | A1 | 4/2015 |
| WO | 2016193806 | A1 | 12/2016 |
| WO | 2018015800 | A1 | 1/2018 |

OTHER PUBLICATIONS

Written Opinion of the International Searching Authority for corresponding PCT/IB2021/057899 dated Nov. 19, 2021.
European Patent Office, Annex to the Communication from the Examining Division regarding EP21763142.3 dated Feb. 8, 2024.

* cited by examiner

FIXING SYSTEM FOR A PANEL COMPRISING MEANS FOR ADJUSTING THE INCLINATION AND RELATIVE PROCEDURE FOR ADJUSTMENT

The subject of this invention is a device designed to adjust the inclination of panels to be installed on a building element so as to define technical structures for protection and/or boundaries and/or furnishing, for example, parapets, railings, banisters, fences, partitions, glazed windows, cantilever roofs, roofs or the like.

More precisely, the purpose of this device is to provide a system that connects panels of any thickness and material (e.g., glass), comprising the means to quickly adjust their inclination with respect to a building element of installation. The device is therefore suitable for use in the field of construction, particularly in the field of transparent architecture.

Of course, nothing prevents the application of the finding to be extended also to fields different from the building one, such as the nautical field.

It is well known that, for the installation of panels on supportive building structures and/or surfaces to be delimited or that need protection, metal profiles are often used, preferably aluminium, which can be anchored to the building component and adapted to serve as a seat and support for said panels, retaining them in a horizontal or vertical position according to the different applications. See, for example, the solutions described and illustrated in documents WO 2016/193806 A1 and/or WO 2018/015800 A1.

Many well-known systems, despite being widespread and already having been in use for a long time, are not free from difficulties in the positioning and installation of the panels If we can certainly admit that all the elements making up an apparatus for connecting panels are perfect from the dimensional point of view or better that their imperfections are absolutely imperceptible and irrelevant from a functional point of view, the same can not be said of the building components whereon such devices must be constrained that may have defects and unacceptable dimensional inaccuracies.

Very often, therefore, to compensate for defects of the lying plane of the installation surface of said profiles, ensuring, as a result, the optimal set-up of the panels that they support, fitting works, adjustments and the masking of said dimensional defects are required. This inevitably ends up complicating and lengthening installation times, as well as requiring close attention and technical preparation on the part of the installers.

It is not always easy to place panels in the correct and desired position, especially if the installer has to work in rather uncomfortable or dangerous places and positions: very often, in order to carry out the assembly of the panels and any adjustment of the set-up thereof, the installer must operate from the outside of the building component of installation, leaning in the mid-air or using special equipment, such as aerial platforms or ladders, at the risk of his own safety.

An incorrect positioning of the panels on the support profile leads to installations that are aesthetically unsatisfactory and/or not fully functional.

Set-up defects are in fact very visible on an array of consecutive panels, especially if having a glossy and/or reflecting surface.

In addition, the current systems used to adjust the set-up have numerous components and require the construction of profiles with a complex shape. This does not facilitate the production and the installation of said systems.

The object of the present invention is to eliminate the drawbacks of the prior art listed above, by designing an innovative apparatus for connecting panels, preferably glazed, to a building component and defining technical structures for the protection and/or delimitation and/or furnishing, such as, by way of a non-limiting example, parapets, railings, balustrades, fences, partition walls, cantilever roofs, roofs and similar elements.

More specifically, the aim of this invention is to provide an innovative system to adjust the set-up of one or more panels to compensate for any dimensional and/or of the planarity defects the installation surface.

A further aim of the invention, at least for one or more embodiments, is to provide a system for adjusting the set-up of one or more panels of any thickness installable by an installer operating in totally safe conditions.

A further aim of this invention, at least for one or more embodiments, is to provide an adjustment system which is easy to realise and comprising a reduced number of components.

These and other aims are achieved according to the invention, with the features listed in the annexed independent claim 1.

Further features of the present invention shall be better highlighted by the following description of a preferred embodiment, in accordance with the patent claims and illustrated, purely by way of a non-limiting example, in the annexed drawing tables, in which:

Figure 1:
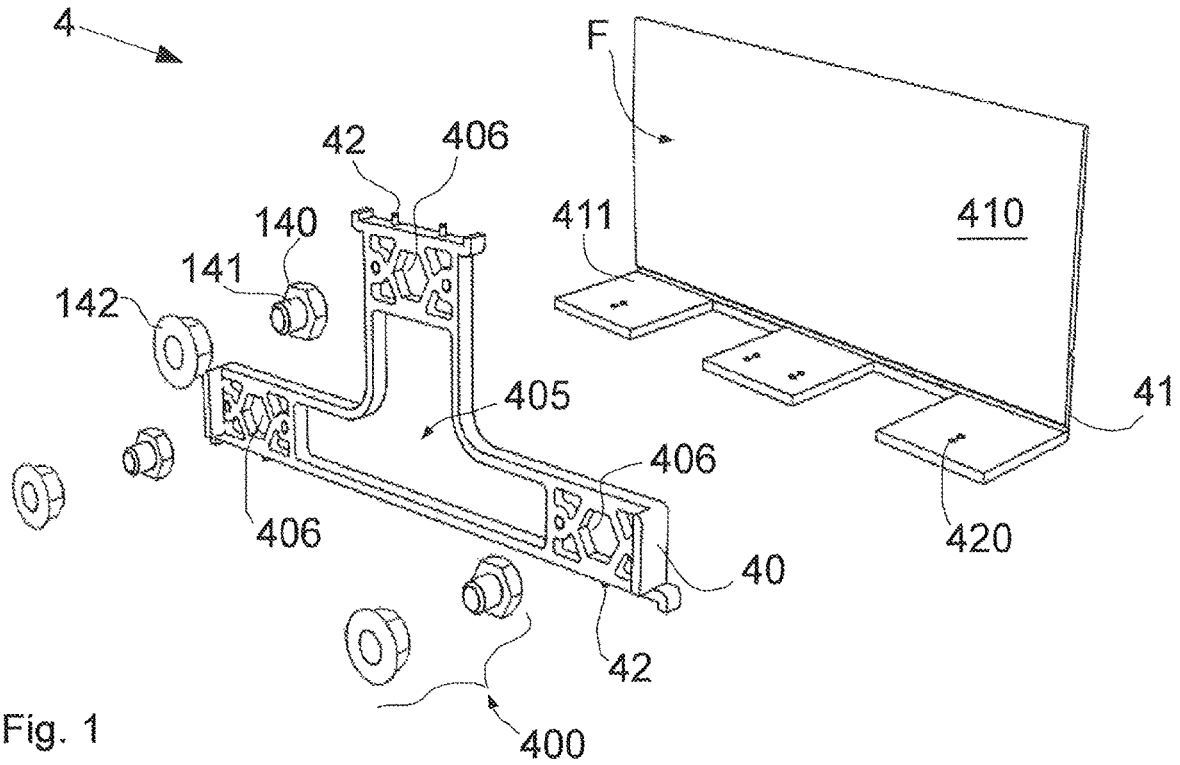
FIG. 1 shows an exploded view of the adjustment assembly for a possible manufacturing variant of the apparatus for connecting panels to a building element according to the invention.
Figure 9:
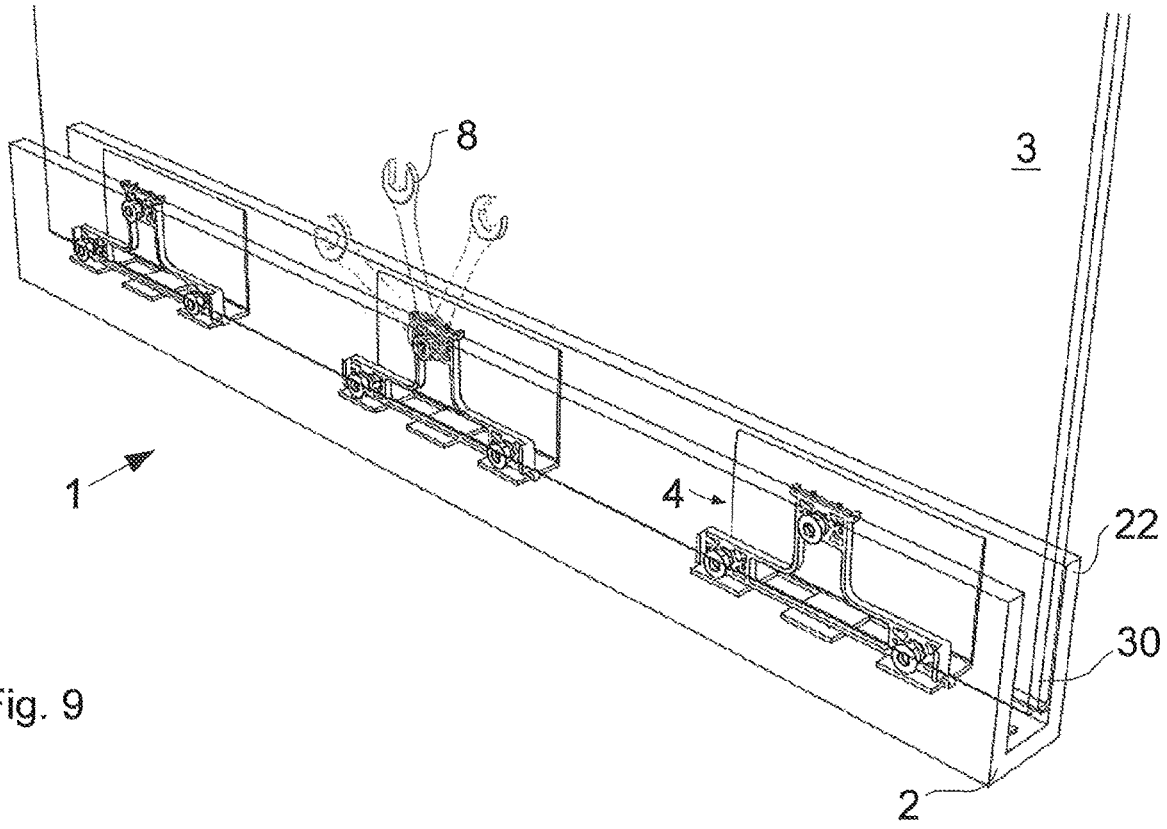
Figure 10A:
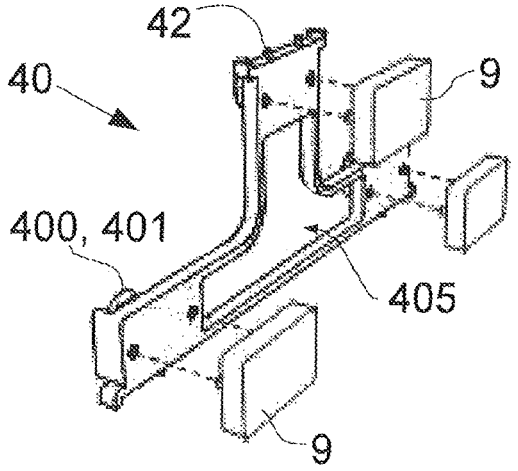
Figure 10B:
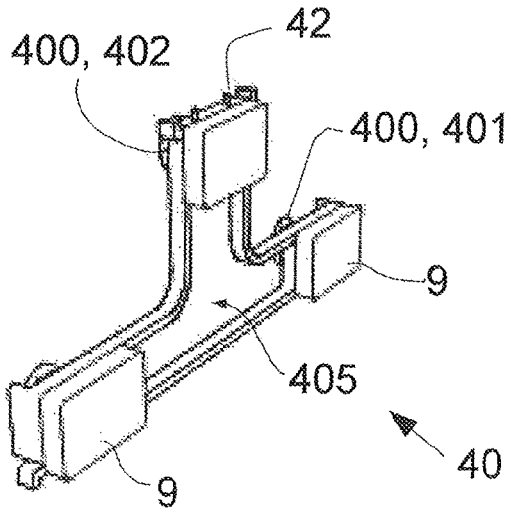
Figure 11A:
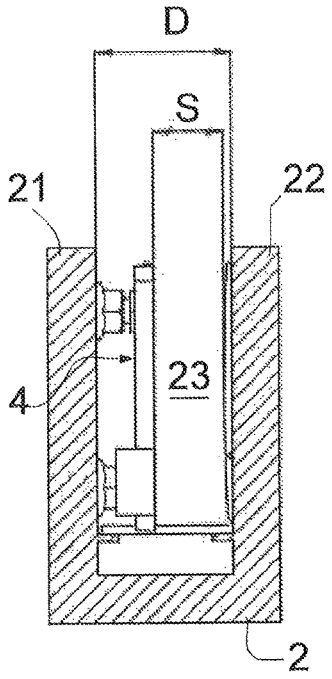
Figure 11B:
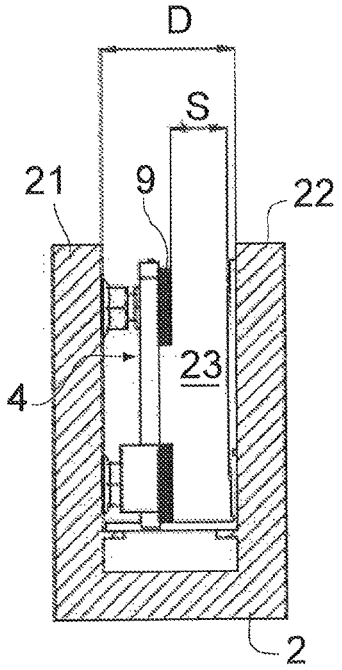
Figure 11C:
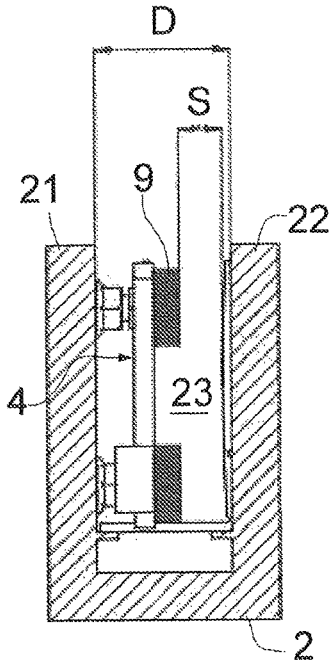
Figure 12A:
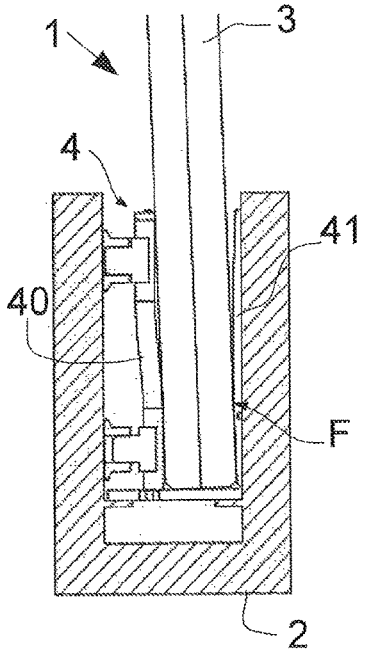
Figure 12B:
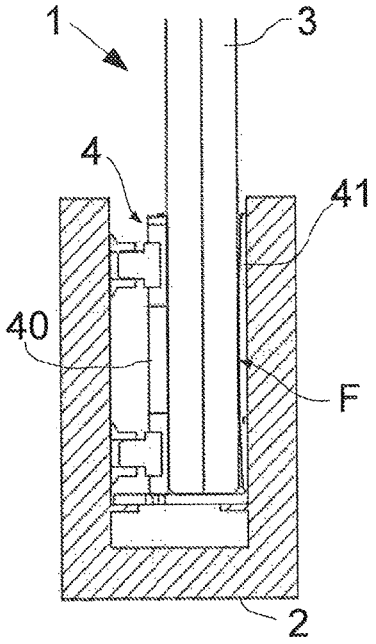
Figure 12C:
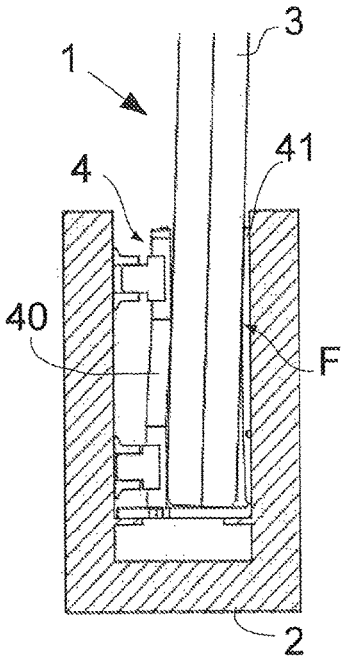
Figure 13A:
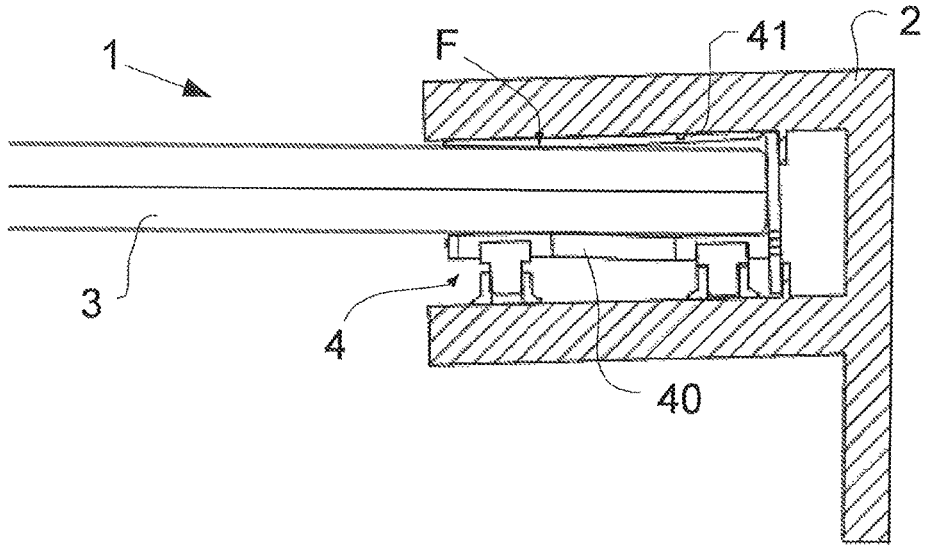
Figure 13B:
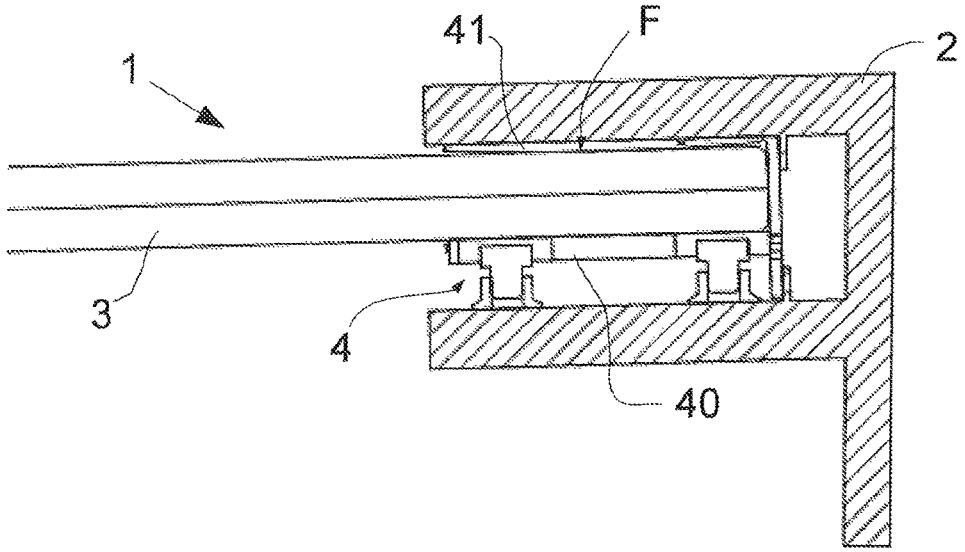
Figure 13C:
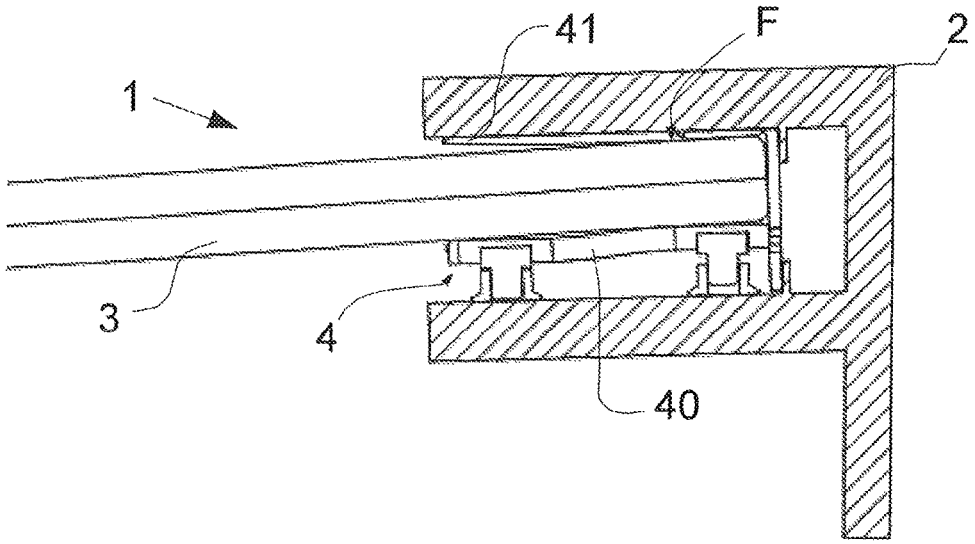
Figure 14:
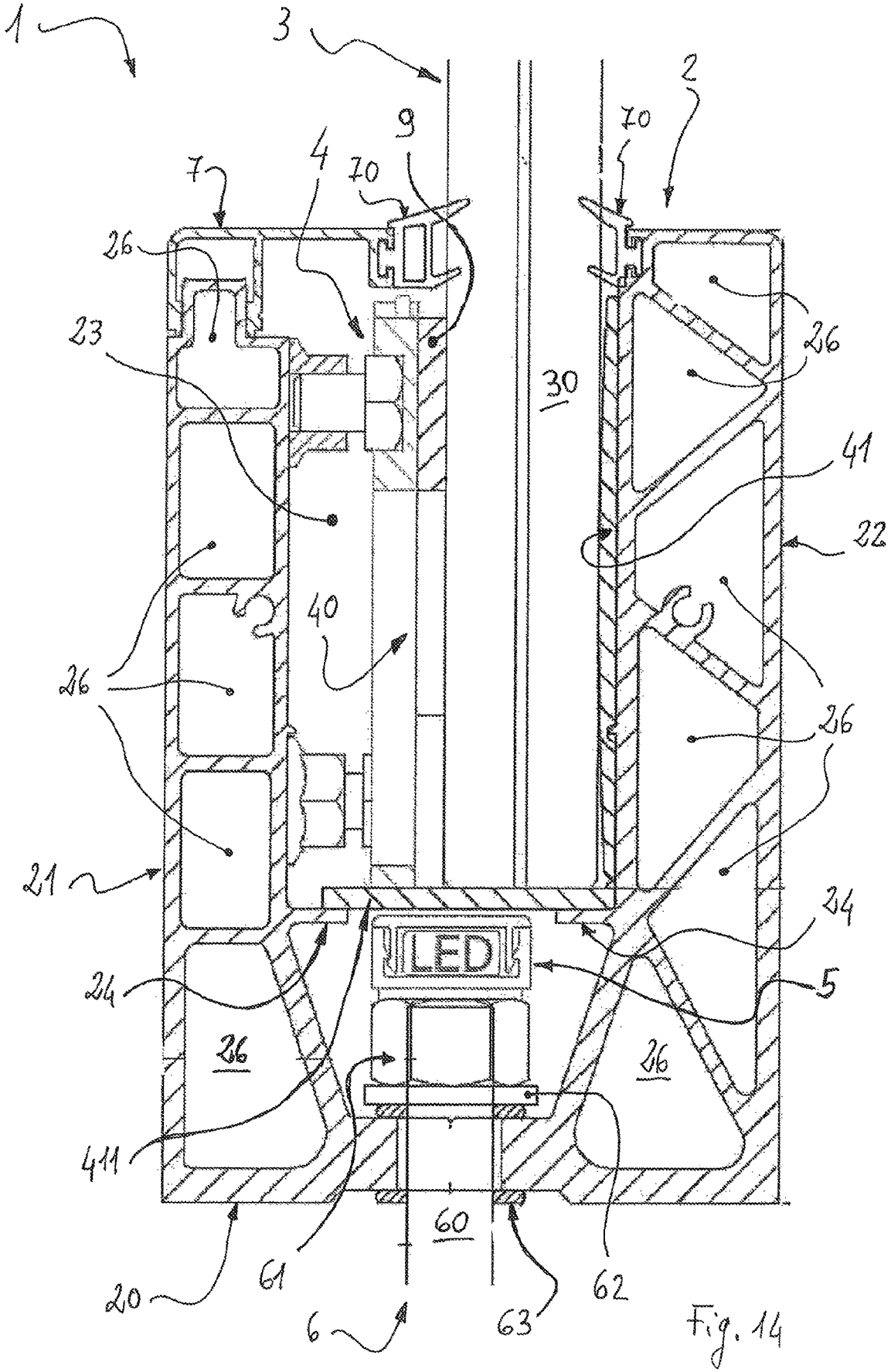
Figure 15B:
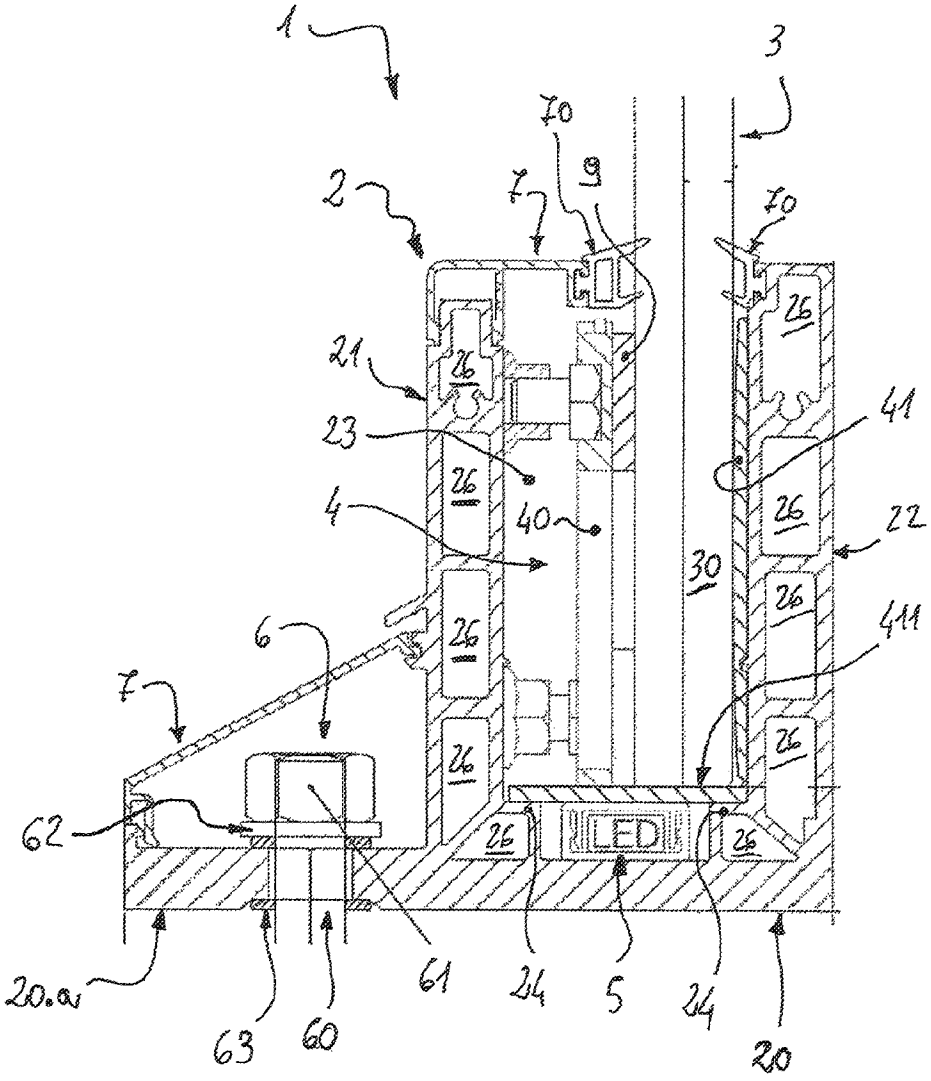
Figure 15A:
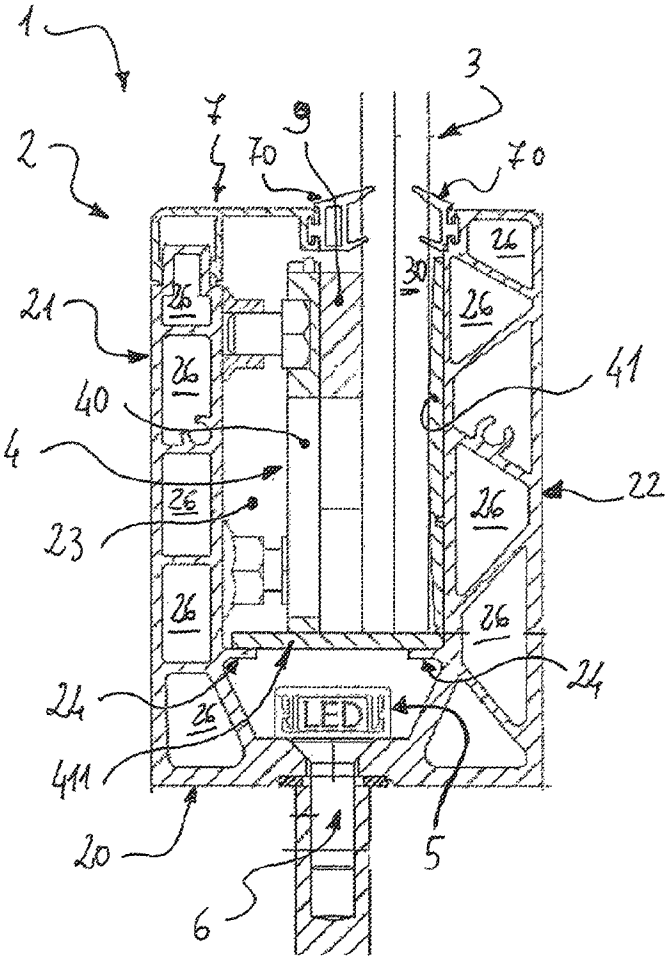
Figure 15C:
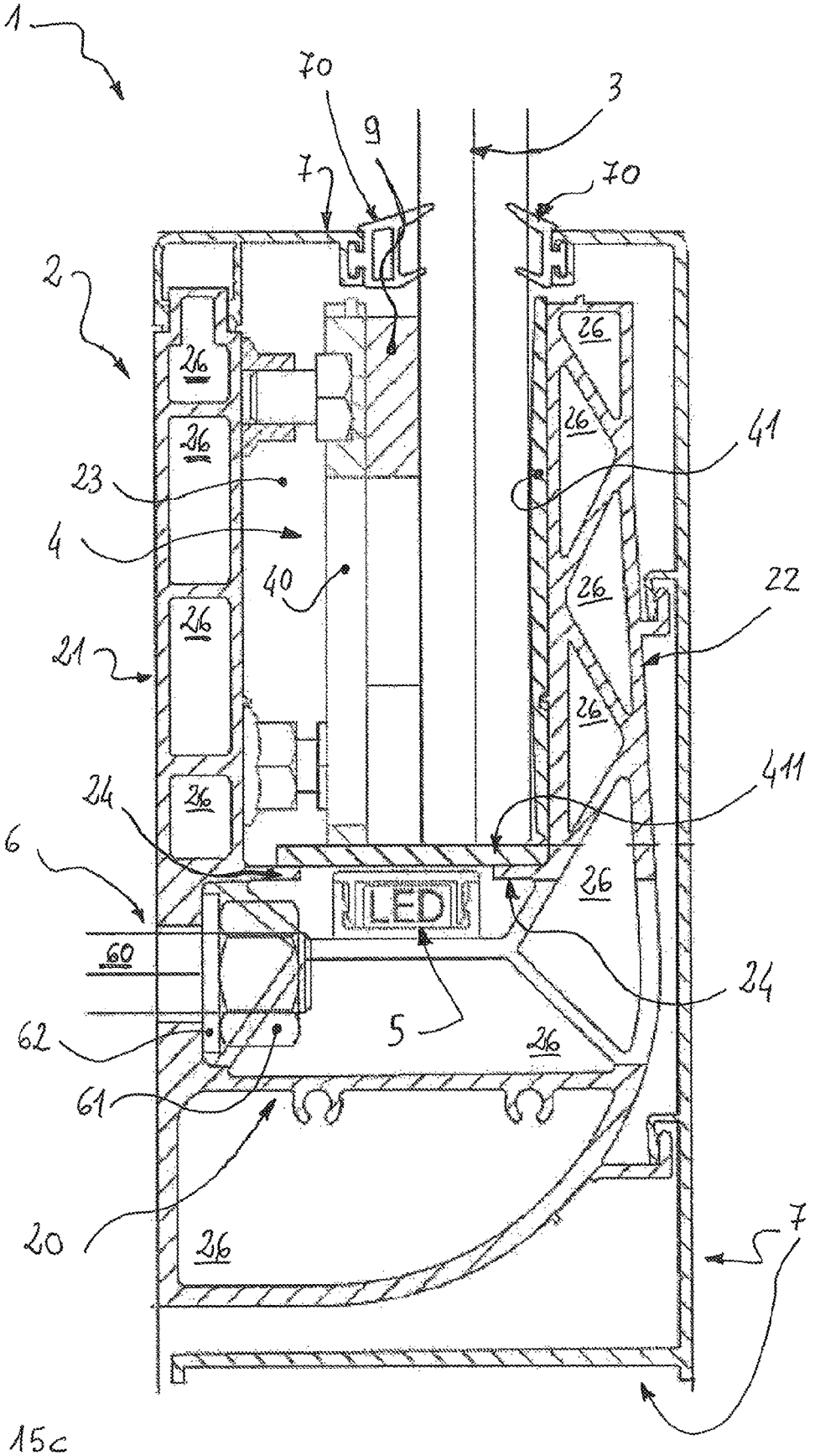

FIG. 8*a, b, c, d, e* show different stages of a possible method for adjusting the laying set-up of a panel;

FIG. 9 shows in detail the adjustment of the laying set-up of a panel;

FIGS. 10*a* and 10*b* show a possible embodiment for a component of the adjustment assembly of FIG. 1;

FIGS. 11*a*, 11*b* and 11*c* show different ways of using the adjustment assembly of FIG. 1 for panels of varying thicknesses;

FIGS. 12*a*, 12*b* and 12*c* show different possible adjustments of the laying set-up of the panel able to define parapets, railings, banisters, fences, partitions, glazed windows or similar frames;

FIGS. 13*a*, 13*b* and 13*c* show different possible adjustments of the laying set-up of the panel able to define cantilever roofs, roofs or the like;

FIG. 14 shows a possible manufacturing variant for the apparatus for connecting panels to a building element according to this invention;

FIGS. 15*a*, 15*b* and 15*c* show further manufacturing variants for the connecting apparatus of FIG. 14 for different installations on a building element.

The elements of the apparatus according to the invention are now described using the references contained in the annexed figures. It should be noted that any dimensional and spatial term (such as "lower", "upper", "right", "left", "vertical", "horizontal" and the like) refers, unless otherwise indicated, to the position according to which the object of the invention is shown in the drawings which not necessarily coincides with the position of the finding in operating conditions. With the purpose of highlighting some features instead of others, not necessarily what described in the annexed drawings is perfectly to scale.

For the sake of simplicity and without any restrictive intent, the term, "panel" is henceforth to be understood as any substantially slab-shaped structural element capable of creating and establishing a technical structure for protection and/or boundaries and/or furnishing, such as: parapets, railings, banisters, fences, partitions, glazed windows, cantilever roofs, roofs or the like.

In general, said panel may include metal sheets, polycarbonate sheets, glass panels, wood, etc., of various thicknesses and finishes.

As clearly shown in the accompanying figures, shown by way of example and by no means an exhaustive list, FIG. 1 shows, in its entirety, an apparatus for connecting one or more panels 3 to a building element and equipped with means for adjusting their laying set-up.

Said connecting apparatus 1 comprises a support profile 2, capable of supporting and retaining at least part of a panel 3.

Said support profile 2 can be made of any suitable metal alloy (aluminium alloys, in general) but there is nothing to prevent it being made from other materials, e.g. wood or PVC, if structural requirements allow for this.

The support profile 2 may have a substantially U-shaped section with an anchor base 20 fixed, through known means 6, to an installation surface of said building element, and a first 21 and second 22 wing, opposite and parallel to each other. Between said wings 21, 22 and the base 20, a cavity 23 is defined acting as a seat for at least a portion or edge 30 of the panel 3, which projects outwards for its remaining part.

In general, said edge 30 cooperates with a suitable support surface inside of said cavity 23.

Preferably, said edge 30 is supported by at least one rib 24 made on each of the two wings 21 and 22 of the support profile 2, projecting inwards from the cavity 23 and advantageously positioned close to the base 20 of said profile, parallel to it.

As will be seen, between said edge 30 and said rib 24 there may be a specific means of support, for example a tab or plate 411, which will be described in greater depth over the course of the discussion with reference to the other functions which it is capable of performing.

Of course, nothing prevents that said edge 30 of the panel 3 could be supported directly by the base 20 of the profile 2.

The connecting apparatus 1 according to this invention further comprises a system to adjust the laying set-up of the panel 3 with respect to the support profile 2, which makes it possible to:

- retain the edge 30 within the cavity 23 of the profile 2; and/or
- adjust the inclination of said panel 3 with respect to the building element of installation and/or other panels 3 adjacent thereto.

For this purpose, said laying set-up adjustment system comprises an adjustment assembly 4 suitably designed to:

- act reciprocally on the opposed sides of the panel 3 so as to lock it in said cavity 23,
- impart to the edge 30 of the panel 3 a controllable rotation around a fulcrum F so as to adjust its inclination and compensate for any dimensional and/or planarity defects of the building element of installation.

More specifically, said adjusting can be achieved by rotating the edge 30 of the panel 3 around said fulcrum F and within the cavity 23 of the support profile 2, between its first 21 and second 22 wings.

According to a preferred form of the invention, said adjustment assembly 4 may preferably comprise:

- a "adjuster support" 40 provided with at least two actuators 400, preferably similar to each other, which can operate on the opposite face of the panel 3 and rotate at least its edge 30, said support 40 being preferably disposed in proximity to said first wing 21 of the profile 2;
- a "stop plate" 41, preferably positioned in proximity to the second wing 22 of said profile 2 and provided with abutment surface 410 capable of associating in front coupling with the other face of the same panel 3 and suitably shaped to define and identify said fulcrum F for the rotation of, at least, the edge 30 of said panel 3.

According to the invention, a temporary coupling is provided between the adjuster support 40 and the stop plate 41 in order to join the parts and facilitate the insertion and installation of the adjustment assembly 4 inside the cavity 23 of the profile 2.

This coupling, in accordance with a possible manufacturing variant, can however be released or altered so as to disconnect the parts and allow, as will be seen, the free movement/translation of the adjuster support 40 inside the profile 2 and the consequent adjustment of the inclination of the panel 3.

As illustrated in FIG. 1 and without any restrictive intent, said coupling is achieved via one or more joints.

For this purpose, the stop plate 41 may be provided with at least one tab or plate 411:

- provided with at least one hole 420 which cooperates with a corresponding interlocking pin 42 provided on the adjuster support 40,
- capable of resting on the aforementioned ribs 24 of the profile 2 or directly on its base 20, said plate 411 therefore also serving, as already partly described above, as a support surface for the edge 30 of the panel 3.

Said interlocking pin 42 may have a weakened section so as to facilitate its breaking during the adjustment procedure. We will return to this aspect in greater detail in the course of this discussion.

In accordance with a preferred embodiment of the invention, said adjuster support 40 should preferably be made of an elastically deformable material.

In this way, as will be seen, by operating the aforementioned actuators 400, said support 40 is suitably deformed so as to allow a crosswise translation of at least a portion thereof inside the cavity 23 of said profile 2 and a consequent interaction of the same with the opposite face of the panel 3, thereby allowing a rotation of at least its edge 30.

Preferably, said at least two actuators 400 include:

- at least one first actuator 401, which will be henceforth referred to as "proximal actuator" as it is positioned substantially near the base 20 of said profile 2;

at least one second actuator 402, which will be henceforth referred to as "distal actuator" as it is positioned in the upper area 25 of said profile 2, preferably near the "mouth" of the cavity 23, said proximal actuator 401 and distal actuator 402 being therefore spaced apart from each other by a suitably distance H selected and defined in order to allow, in the manner which will be shown, an effective rotation of at least the edge 30 of said panel 3.

Figure 5:
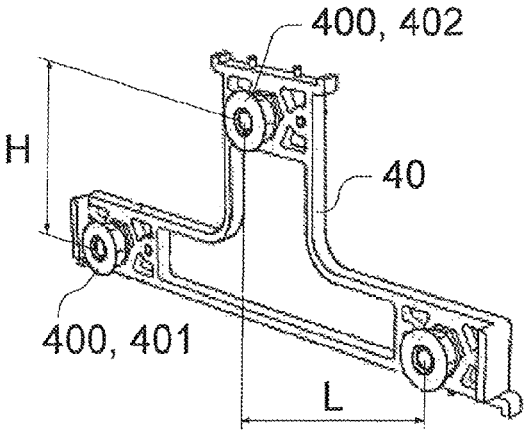
FIG. 5 shows an isometric view of a possible embodiment for a component of the adjustment assembly of FIG. 1.
Figure 7:
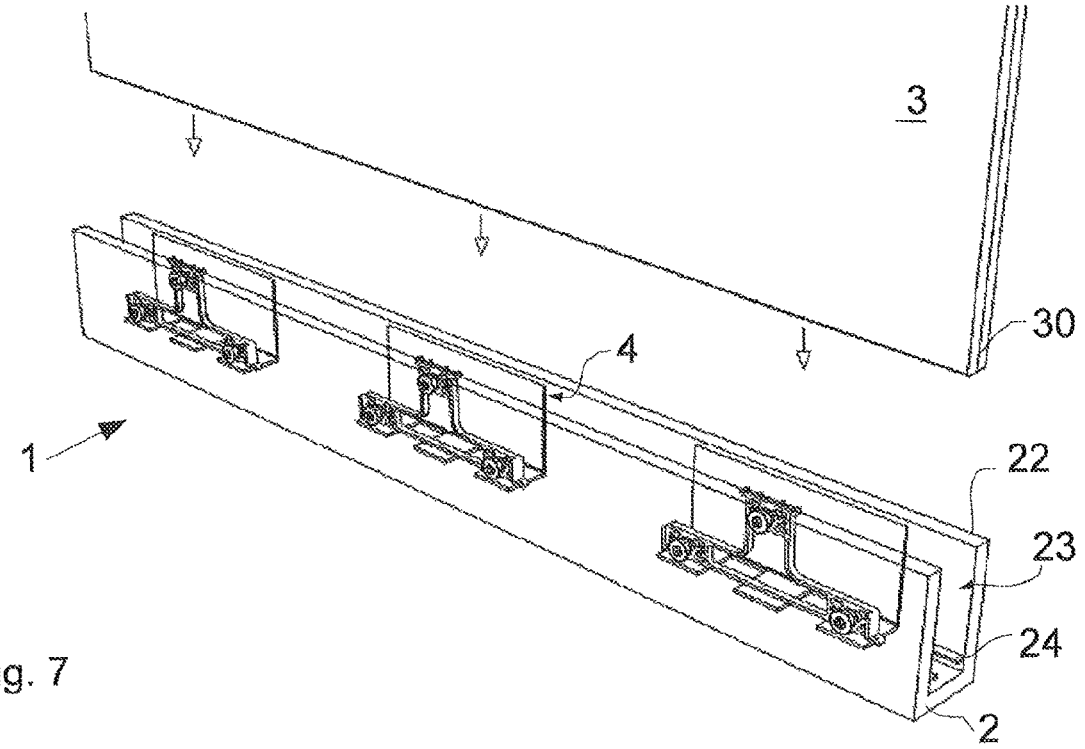

Furthermore, as shown in FIG. 5, since said actuators 401 and 402 can be operated from the outside of the support profile 2 by inserting a manoeuvring tool 8 (e.g. a spanner, a screwdriver or the like), through the "mouth" of its cavity 23, it is necessary that each proximal actuator 401 is misaligned and offset by a distance L with respect to each distal actuator 402, so that they are all indifferently and easily accessible by said manoeuvring tool 8 (see FIG. 9).

In other words, the distal actuator 402 must not be an obstacle that prevents the manoeuvring tool 8 from interacting with the proximal actuator 401.

As clearly shown in FIG. 1, the actuators 400, 401, 402 may consist of adjusting screws comprising:

- a first head 140 retained in a seat 406 of the adjuster support 40, prevented from being rotated due to interference or shape coupling, said seat 406 being preferably a blind seat suitable to also prevent free movements/translation of said first head 140 towards the inside of the cavity 23;
- a threaded pin 141, integral to said first head 140, which projects transversely from said seat 406;
- a second head 142, coaxial to said pin 141, whereon it is screwed/unscrewed by means of a manoeuvring tool 8, and cooperating with the inner wall of said first wing 21, which acts substantially as a stop.

According to said arrangement, when the second head 142 rotates on the threaded pin 141, which is fixed and locked to the adjuster support 40 via the first head 140, there is a corresponding crosswise translation, inside the cavity 23 of the profile 2, of the part of the adjuster support 40 to which it is constrained, said translation, as already partly described, causing a consequent rotation around the fulcrum F of at least the edge 30 of the panel 3.

In fact, said second head 142 is substantially in contact with the internal wall of the first wing 21 and when it is activated using the tool 8, it transfers the rotation movement to the first head 140 via the threaded pin 141.

Said first head 140, which is placed and locked inside the blind seat 406, unable to rotate or translate, "releases" the movement generated by the second head 142 on the adjuster support 40, elastically deforming at least the area surrounding said seat 406.

Therefore, the adjuster support 40 transfers the movement of the actuators 401 and 402 to the edge 30 of the panel 3, via a controlled deformation of its parts surrounding the blind seats 406 on which the respective heads 140 are positioned.

Said movement of the actuators 401 and 402, in combination with the abutment surface 410, allows the panel 3 to rotate around the fulcrum F and therefore to adjust its inclination with respect to the building element.

For this reason, the aforementioned abutment surface 410 of the stop plate 41 is fixed and preferably convex so that each of its points can act as a fulcrum F during the rotation of the edge 30 of the panel 3.

To ensure that said rotation occurs, the projection of the fulcrum F on the opposed first wing 11 should preferably "fall" in the space H between the proximal actuator 401 and the distal actuator 402.

There is, of course, nothing to prevent the abutment surface 410 from being substantially flat but equipped with at least one suitable abutment element (not shown in the figures) from which it protrudes to act as a fulcrum F.

Therefore, as shown in the attached figures, by screwing/unscrewing each of the actuators 401 and 402 with the aid of a tool 8, the adjuster support 40 can be translated, by deformation of the latter, transversely within the cavity 23 of the profile 2 to the most suitable extent for adjustment.

More precisely, by suitably acting on the actuators 401 and 402, it is possible to translate the part of the adjuster support 40 surrounding the distal actuator 402 against the panel 3 and, at the same time, it is possible to retract the part of the support 40 surrounding the proximal actuator 401 in the opposite direction, thereby causing a clockwise rotation of the panel 3; vice versa, the panel 3 can rotate counterclockwise if actuators 401 and 402 are operated in the opposite manner.

In essence, the adjuster support 40 is deformed by changing the reciprocal position of at least the portions comprising the blind seats 406 in which the respective actuators 401, 402 are located.

Such translations will naturally be prolonged until the desired inclination of the panel 3 is reached.

The results of the rotation of the panel 3 in the respective support profile 2 are clearly visible in FIGS. 12*a*, 12*b* and 12*c*, which show different inclinations of the panel 3 with respect to its vertical position, that compensate for inclines and defects in the flatness of the installation surfaces for the building element. Following completion of this adjustment, the adjustment assembly 4 also acts as locking means 4 for the panel 3, which is firmly and definitively retained in the desired set-up, clamped between the actuators 401 and 402 and the opposing abutment surface 410.

In accordance with a possible manufacturing variant of this invention, the adjuster support 40 may comprise a plurality of proximal 401 and/or distal 402 actuators so as to adapt the adjustment assembly 4 to different types of loads and to effectively improve the distribution of the stresses along the edge 30 of the panel 3.

Figure 2:
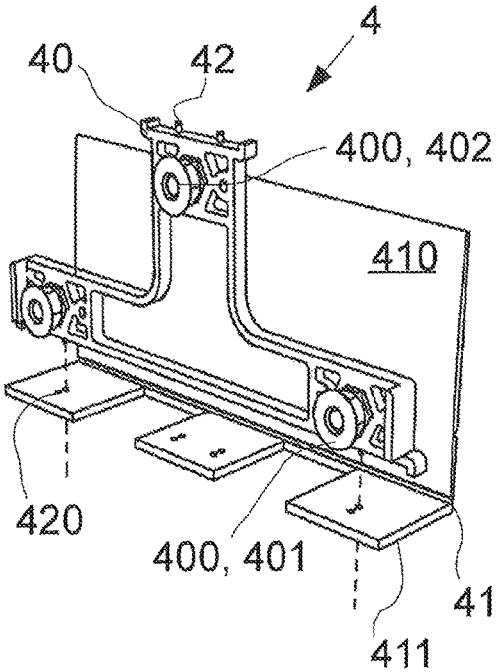
FIG. 2 shows a first possible assembly manner for the adjustment assembly of FIG. 1.
Figure 3:
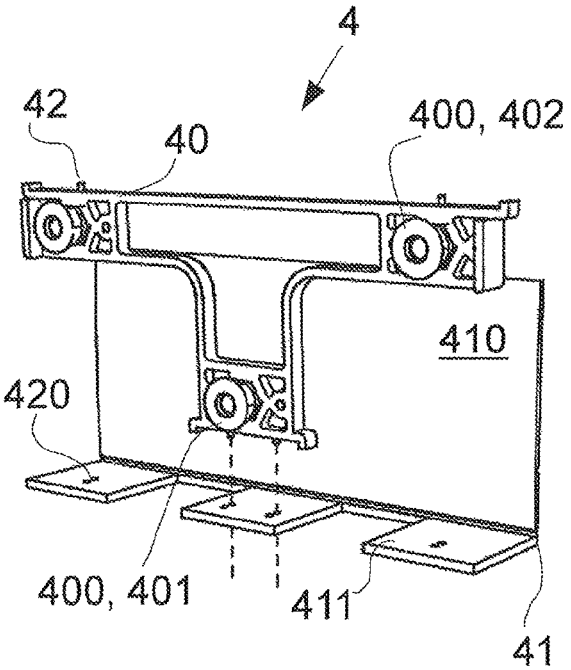
FIG. 3 shows a second possible assembly manner for the adjustment assembly of FIG. 1.
Figure 4:
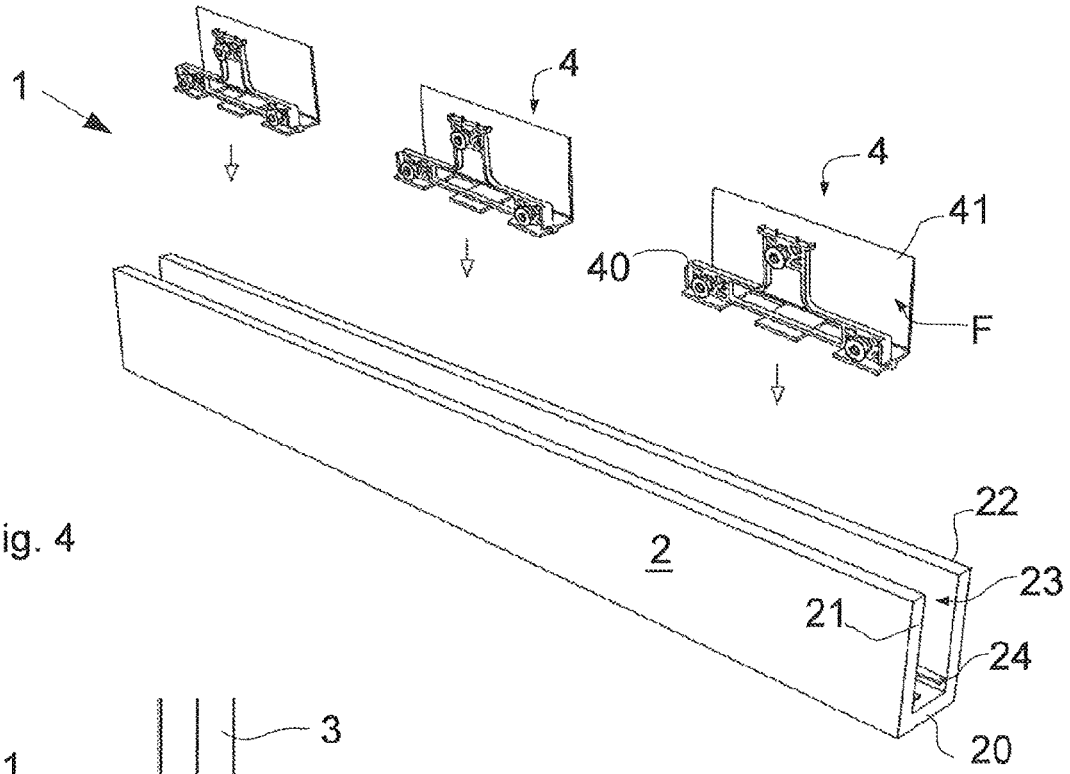
FIG. 4 shows the first assembly stage for the apparatus for connecting panels according to this invention.
Figure 6:
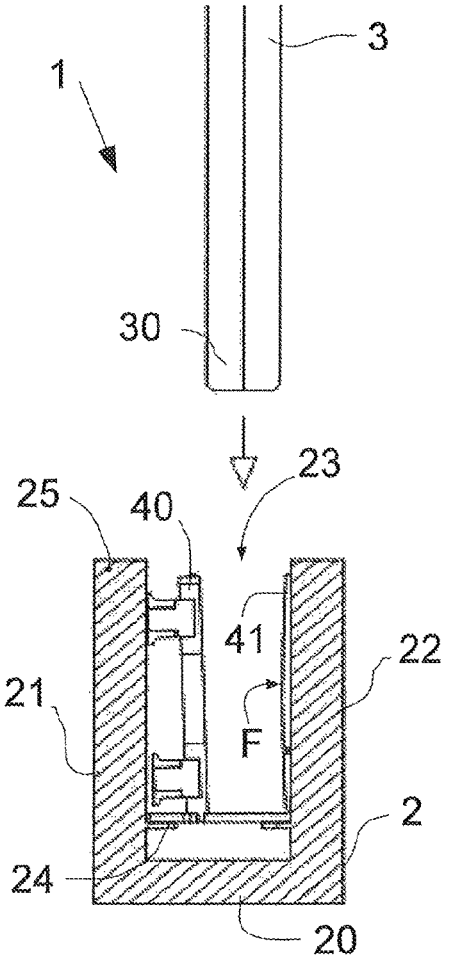
FIGS. 6 and 7 show a second assembly stage for the apparatus for connecting panels according to this invention.

For example, in the case of a banister, if it is possible to predict in advance the type and direction of the load the banister must respond to, the adjuster support may provide:

- a greater number of proximal actuators 401 than distal actuators 402, for example two proximal actuators 401 and one distal actuator 402, said arrangement being better suited to respond to loads coming from the side of the first wing 21 (FIG. 2); or
- a greater number of distal actuators 402 than proximal actuators 401, for example two distal actuators 402 and one proximal actuator 401, said arrangement being better suited to respond to loads coming from the side of the second wing 22 (FIG. 3).

In accordance with a possible manufacturing variant of the invention, this can be advantageously achieved by making a T-shaped adjuster support 40 comprising a plurality of said blind seats 406 (e.g., blind holes), suitably and variably shaped to accommodate the actuators 401, 402.

In this case, by inverting the "T", i.e. by changing the orientation of the adjuster support 40 inside the profile 2 where it is mounted, it is possible to counteract and respond adequately to the different types of load that are expected to act on the panel 3 when in use and operational (FIGS. 2 and 3).

In addition, the adjuster support 40 can be fitted with a lightening central cavity or opening 405 and adapted to make it more deformable during the aforementioned adjustment phase.

Figure 8:
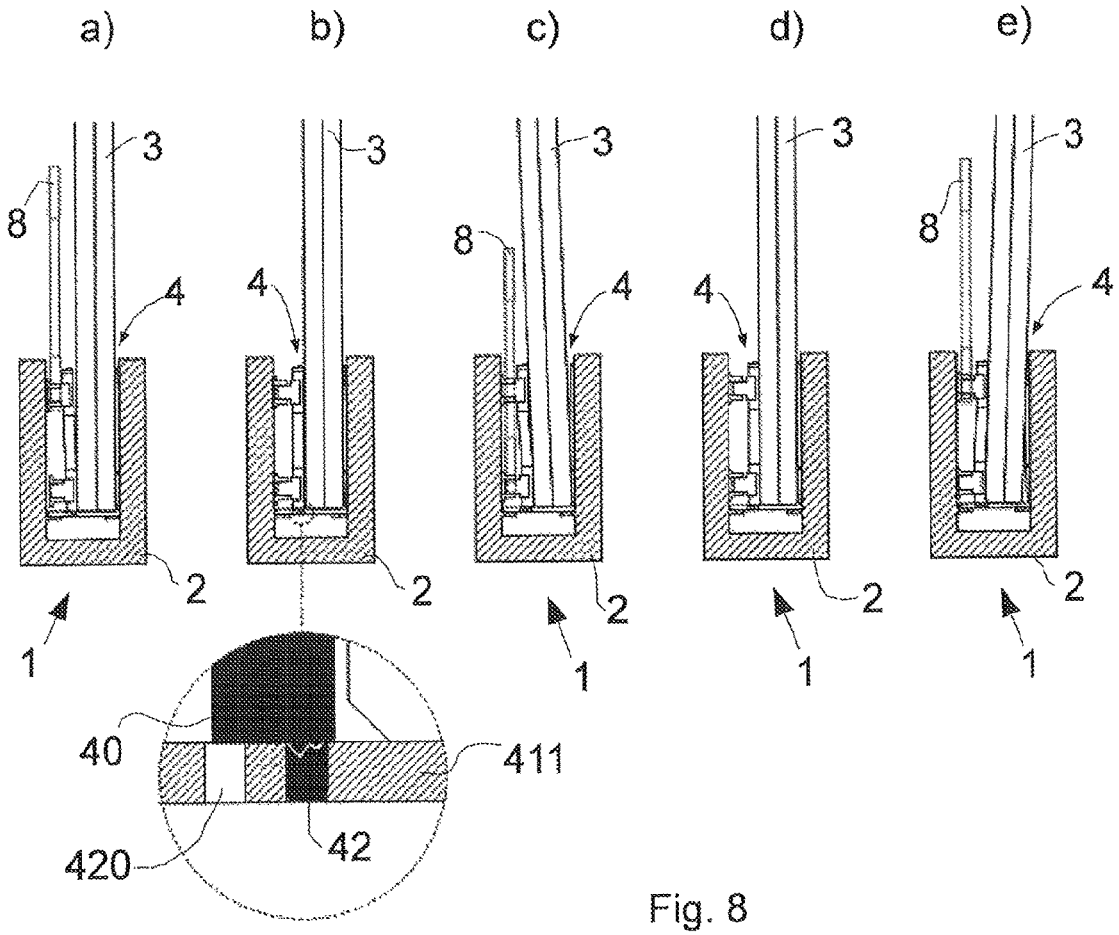

A possible adjustment procedure for the inclination of the panel 3, illustrated in FIG. 8, may comprise the following steps:

a) operate the proximal actuators 401 and/or distal actuators 402 to tilt the panel 3, bring it towards a set-up of greater inclination and break the interlocking pin 42, said "break" uncoupling and disengaging the adjuster support 40 from the stop plate, 41 making it free to move and deform during the adjustment;

b) proceed with said adjustment of the inclination by operating actuators 401 and/or 402;

c) if necessary, further tighten said proximal 401 and distal 402 actuators at least until the panel 3 is finally locked in the desired setup.

In general, depending on the actuator operated and the translation exerted, the interlocking pin 42 can be broken:

by the movement of the edge 30 of the panel 3 if the distal actuator 402 is moved/translated towards the inside of the cavity 23 and the proximal actuator 401 is moved/translated towards the first wing 21;

by the deformation and movement of the adjuster support 40 if the distal actuator 402 is moved/translated towards the first wing 21 and the proximal actuator 401 is moved/translated towards the inside of the cavity 23.

As already mentioned several times, the apparatus for the connection of one or more panels 3 to a building element according to this invention can be used to make parapets, railings, banisters, fences, partitions, glazed windows or similar frames, as illustrated in FIGS. 12*a*, 12*b* and 12*c*, or to define cantilever roofs, roofs or the like as illustrated in FIGS. 13*a*, 13*b* and 13*c*.

In these figures, the deformation of the adjuster support 40 is clearly visible and it is also clearly understandable how this deformation is dependent on and varies according to the adjustment made.

In order to facilitate the aforementioned operations of adjusting the inclination and locking the panel 3, the wing 21 upon which the adjuster support 40 is placed should preferably be the one which can be reached by the installer without the need to lean out dangerously or to use aerial or suspension equipment.

In this way, the installer can always install and adjust the set-up of the panel 3 in a completely safe and comfortable manner.

For example, in the case of fitting banisters, parapets or the like, said first wing 21 is the one facing the inside of the building element of installation, while the opposite wing 22 which holds the stop plate 41 is the external one.

Similarly, in the case of cantilever roofs and roofs, the first wing 21 is the one normally directed towards the ground or a walkway accessible to users, while the second wing 22 is the one directed upwards, e.g. towards the sky.

It is clear that, in the practical implementation of the invention, numerous modifications and further variants may be possible, all falling within the same inventive concept; moreover, all the various components and details described above may be replaced by technically equivalent elements.

For example, there is nothing to prevent the adjuster support 40 from being equipped with one or more spacers 9 that allow the adjustment assembly 4 to cooperate with panels 3 of different thicknesses.

Said spacers 9 may be positioned on the side of the adjuster support 40 in direct contact with the edge 30 of the panel 3 and, depending on the type of application, may have different thicknesses.

FIGS. 11*a*, 11*b* and 11*c* show different profiles 2 having the same width D of the cavity 23, but varying distances S between the stop plate 41 and the adjuster support 40 depending on the different types of spacers 9 used.

Each distance S can therefore be suitably adapted to accommodate panels 3 of different thicknesses, making the support profile 2 adaptable to many applications and types of panels 3.

Furthermore, according to a possible manufacturing variant, there is nothing to prevent the above-mentioned stop plate 41 from being integrated to and part of the wing 22 of the profile 2.

Although, in FIGS. 4 to 13*c*, the U-shaped supporting profile 2 of the apparatus 1 for the connection of one or more panels 3 to a building element is shown as a "solid" profile, there is nothing to prevent its wings 21, 22, and possibly its anchor base 20, from featuring one or more internal cavities 26, as shown in FIG. 14 and/or FIGS. 15*a* to 15*c*.

In fact, it has been found that having a hollow structure in the support profile 2, in particular in its wings 21, 22, substantially reduces the weight of the connection apparatus 1 and the risk of breaking the panel 3, especially if it is made of glass, both during the adjustment of its inclination, as illustrated, and, under operating conditions, when subjected to heavy loads, such as accidental impacts, strong wind, or other occasional atmospheric disturbances.

More precisely, the presence of one or more of said cavities 26 makes the wings 21, 22 more elastic and/or flexible, thus offering less resistance when adjusting the inclination of the panel 3 or in the presence of said accidental and/or occasional loads, and reducing, as a consequence, the risk of its breakage.

Without any restrictive intent, said cavities 26 may be formed according to a predetermined arrangement, for example such as to form a substantially reticular and/or honeycomb structure, or, alternatively, they may be located only in certain points of said wings 21, 22, for example in areas which are most likely to offer resistance to the adjustment of the panel 3 or to said loads.

It has also been found to be particularly useful to use one or more of said cavities 26 to house at least one light source 5, for example an LED light, with the purpose of illuminating the panel 3.

For example, said light source 5 can be inserted into a cavity 26 of said wings 21, 22 preferably located close to the base 20 of said support profile 2, so as to allow illumination from below of said panel 3. From an inventive point of view, however, alternative locations for said light source 5 are completely indifferent and technically equivalent; for example, the light source 5 can be located inside the seat 23 of the support profile 2, which is normally suitable for retaining and accommodating a portion or edge 30 of the panel 3, and substantially supported by the base 20 of said profile 2, and/or in a specific housing located on said base 20.

Finally, it should be pointed out that, like the "solid" support profiles 2, the "hollow" ones in FIGS. 14 to 15*c* can be installed in any building element to form parapets, railings, banisters, fences, partitions, glazed windows, cantilever roofs, roofs or the like.

By way of example, the support profiles 2 of FIGS. 14, 15*a* and 15*b* allow, by means of known fastening systems 6 (e.g. a combination: threaded screw 60, possible nut 61 and washer 62, gaskets 63, or similar) an installation on the floor/ceiling (or on the wall in the case of a cantilever roof/roof), either in a projecting manner or "drowned" in it, while those shown in FIG. 15*c* are particularly suitable for a "lateral" application, i.e. on a vertical shoulder or wall of the floor itself and/or of a balcony (in this regard, see the essentially horizontal arrangement of the screw 60 for fixing the support profile 2 to a building element).

With specific reference to the variant of the support profile 2 shown in FIG. 15*b*, it is noted that its base 20 comprises at least one attachment 20.*a*, which is substantially coplanar, to offer an alternative method of installation on a building element to that shown in FIGS. 14 and/or 15*a*.

For example, said attachment 20.*a* can allow greater freedom of installation, depending on the dimensional and surface characteristics of the building element and, at the same time, provides an additional surface for the fastening system 6 of the supporting profile 2 on the building element itself. This allows access to said fastening system 6, for example for maintenance and/or adjustments, without first having to remove the panel 3 from the relevant profile 2 (as is the case with the variants in FIGS. 14 and/or 15*a*).

Furthermore, it is possible to provide said support profiles 2, both "hollow" and "solid", with specific covers or casings 7 applicable, e.g, in a "Snap-on", or interlocking manner or similar, for aesthetic purposes or for protection of the profiles 2 of the invention or parts thereof.

Finally, there is nothing to prevent appropriate and well-known gaskets 70 being provided for the cavity 23 of the support profile 2 adapted to retain the portion or edge 30 of the panel 3, said gaskets may cooperate with the covers 7 themselves and/or with the distal ends of the wings 21 and/or 22 of the profile 2 itself.

In conclusion, the apparatus for connecting one or more panels 3 to a building element according to this invention facilitates:

- the use of standard support profiles or simple geometric profiles, thereby making them easy to manufacture;
- ease of transport as, thanks to the reduced number of components and to their dimensions, it is possible to conceivably use boxes for the support profiles and envelopes or small boxes for the components of the adjustment assembly;
- simple and safe installation of the panels.

The invention claimed is:

1. An apparatus for connecting at least one panel to a building element, the apparatus comprising:

a support profile having an anchor base, the anchor base adapted to fix to an installation surface of the building element, said support profile having a first wing and a second wing opposed to one another, wherein a cavity is defined between the first wing and the second wing, the cavity adapted to act as a receptacle for a portion or edge of the at least one panel;

a laying set up adjustment system cooperative with said support profile so as to adjust an inclination of the at least one panel with respect to the building element or to the at least one panel adjacent thereto, said laying set up adjustment system comprising:

an adjustment system adapted to impart an controllable rotation of the edge of the at least one panel around a fulcrum and adapted to adjust the inclination of the at least one panel, said adjustment assembly comprising:

an adjuster support positioned adjacent to the first wing of said support profile, said adjuster support having at least two actuators, the at least two actuators adapted to operate on an opposite face of the at least one panel so as to rotate the edge of the at least one panel; and a stop plate positioned adjacent to the second wing of s support profile, said stop plate having an abutment surface, the abutment surface adapted to couple to another face of the at least one panel, said stop plate shaped to define the fulcrum of rotation of the edge of the at least one panel, the at least two actuators comprising at least one proximal actuator positioned adjacent to the anchor base of said support profile and at least one distal actuator positioned at an upper area of said support profile adjacent to a mouth of the cavity, wherein said adjuster support is deformable and is translatable crosswise in the cavity by operating the at least one proximal actuator and the at least one distal actuator and adapted to operate on the opposite side of the at least one panel so as to cause the rotation of the edge of the at least one panel.

2. The apparatus of claim 1, wherein the at least two actuators comprise:

a first head retained in a seat of said adjuster support, the seat of said adjuster support being a blind seat that prevents a translation of said first head toward an interior of the cavity of said support profile;

a threaded pin integral with said first head and projecting transversely from the seat of said adjuster support; and a second head coaxial with said threaded pin, said second head adapted to be screwed or unscrewed by a tool, said second head being cooperative with an inner wall of the first wing of said support profile; wherein a rotation of said second head on said threaded pin corresponds to a crosswise rotation of a portion of said adjuster support inside the cavity of said support profile.

3. The apparatus of claim 1, wherein said adjuster support and said stop plate are coupleable so as to define said adjustment assembly so as to be insertable and housed inside the cavity of said support profile.

4. The apparatus of claim 3, wherein a coupling between said adjuster support and said stop plate is releaseable or alterable so as to allow an adjustment of the inclination.

5. The apparatus of claim 4, wherein at least one joint is the coupling between said adjuster support and said stop plate, said stop plate having at least one plate, the at least one plate having at least one hole that is cooperative with a corresponding interlocking pin of said adjuster support.

6. The apparatus of claim 1, wherein the at least one proximal actuator and the at least one distal actuator are in spaced relation by a distance defined and adapted to allow the rotation of the edge of the at least one panel.

7. The apparatus of claim 1, wherein the at least one proximal actuator and the at least one distal actuator are misaligned and offset from each other by a distance and adapted such that the at least one distal actuator is not an obstacle to an interaction of the tool with the at least one proximal actuator.

8. The apparatus of claim 1, wherein the abutment surface is fixed and convex so as to define the fulcrum for the rotation of the edge of the at least one panel.

9. The apparatus of claim 1, wherein the at least one panel comprising a plurality of panels, wherein said adjuster support has at least one spacer, the at least one spacer enabling said adjustment assembly to cooperative with the plurality of panels in which the plurality of panels have differing thicknesses.

10. The apparatus of claim 1, wherein said adjuster support has a T-shape and has a central cavity.

11. The apparatus of claim 1, wherein the at least one proximal actuator comprises a plurality of proximal actuators, wherein the at least one distal actuator comprises a plurality of distal actuators, the plurality of proximal actuators being of a number that is greater than a number of the plurality of distal actuators.

12. The apparatus of claim 1, wherein the at least one proximal actuator comprises a plurality of proximal actuators, wherein the at least one distal actuator comprises a plurality of distal actuators, the plurality of distal actuators being of a number greater than a number of the plurality of proximal actuators.

13. The apparatus of claim 1, wherein the at least one proximal actuator is two proximal actuators, the at least one distal actuator being one distal actuator.

14. The apparatus of claim 1, wherein the at least one proximal actuator is one proximal actuator, the at least one distal actuator being two distal actuators.

15. The apparatus of claim 1, wherein the first wing and the second wing of said support profile define a plurality of cavities.

16. The apparatus of claim 15, further comprising:

at least one light source adapted to illuminate the at least one panel, said at least one light source being inserted in at least one of the plurality of cavities.

17. The apparatus of claim 1, further comprising:

at least one light source adapted to illuminate the at least one panel, said at least one light source being inserted in a housing of the anchor base of said support profile.

18. The apparatus of claim 1, further comprising:

at least one light source adapted to illuminate the at least one panel, said at least one light source being inserted internal to the cavity of said support profile.

19. A method of adjusting an inclination of the at least one panel relative to the building element by the apparatus of the claim 1, the method comprising:

activating the at least one proximal actuator or the at least one distal actuator so as to tilt the at least one panel so as to bring the at least one panel toward a set-up of an inclination and to break an interlocking pin;

uncoupling and disengaging said adjuster support from said stop plate so as to allow the adjuster support to be free to move and deform during adjustment; and adjusting the inclination by operating the at least one proximal actuator or the at least one distal actuator.

20. The method of claim 19, further comprising:

tightening the at least one proximal actuator and the at least one distal actuator.

* * * * *